US007771498B2

(12) United States Patent
Sung

(10) Patent No.: US 7,771,498 B2
(45) Date of Patent: Aug. 10, 2010

(54) SUPERABRASIVE TOOLS HAVING IMPROVED CAUSTIC RESISTANCE

(76) Inventor: Chien-Min Sung, 64 Chung-San Rd., Ying-Ko Factory, Taipei County (TW) 23911

( * ) Notice: Subject to any disclaimer, the term of this patent is extended or adjusted under 35 U.S.C. 154(b) by 633 days.

(21) Appl. No.: 11/436,881

(22) Filed: May 17, 2006

(65) Prior Publication Data

US 2007/0266639 A1 Nov. 22, 2007

(51) Int. Cl.
*B24B 1/00* (2006.01)
*B24D 3/02* (2006.01)
*B01J 3/06* (2006.01)

(52) U.S. Cl. ..... 51/295; 451/56; 51/307; 423/446

(58) Field of Classification Search ..... 51/308–309, 51/293, 295, 307; 451/56; 423/446
See application file for complete search history.

(56) References Cited

U.S. PATENT DOCUMENTS

RE35,812 E 6/1998 Oliver
6,517,424 B2 2/2003 Wielonski et al.
6,884,155 B2 4/2005 Sung et al.
2004/0031438 A1 2/2004 Sung
2004/0079033 A1* 4/2004 Long ..... 51/298
2004/0112359 A1 6/2004 Sung
2004/0235406 A1 11/2004 Duescher
2005/0095959 A1* 5/2005 Sung ..... 451/56

* cited by examiner

*Primary Examiner*—Jerry Lorengo
*Assistant Examiner*—Shuangyi Abu Ali
(74) *Attorney, Agent, or Firm*—Thorpe North & Western LLP

(57) ABSTRACT

Superabrasive tools having improved caustic resistance and their methods of manufacture are disclosed. One aspect may include a method of providing caustic resistance along an entire working surface of a superabrasive tool having embedded superabrasive particles. Such a method may include forming a protective layer through reaction between a reactive source and a reactive element in situ along substantially all of the working surface at an interface between the reactive source and a support matrix including the reactive element, and between each of a plurality of superabrasive particles and the support matrix. At least a portion of the reactive source may then be removed to expose the protective layer. In some aspects, the protective layer may be substantially continuous.

12 Claims, 2 Drawing Sheets

SUPERABRASIVE TOOLS HAVING IMPROVED CAUSTIC RESISTANCE

FIELD OF THE INVENTION

The present invention relates generally to superabrasive tools having improved caustic resistance and associated methods. Accordingly, the present invention involves the chemical and material science fields.

BACKGROUND OF THE INVENTION

Many industries utilize tools in acidic or other caustic environments. For example, the computer manufacturing industry relies heavily on chemical mechanical polishing (CMP) processes for polishing wafers of ceramics, silicon, glass, quartz, and metals. Such polishing processes generally entail applying the wafer against a rotating pad made from a durable organic substance such as polyurethane. A chemical slurry is utilized that contains a chemical capable of breaking down the wafer substance and an amount of abrasive particles which act to physically erode the wafer surface. The slurry is continually added to the rotating CMP pad, and the dual chemical and mechanical forces exerted on the wafer cause it to be polished in a desired manner. Of particular importance to the quality of polishing achieved is the distribution of the abrasive particles throughout the pad. The top of the pad holds the particles by means of fibers or small pores, which provide a friction force sufficient to prevent the particles from being thrown off of the pad due to the centrifugal force exerted by the pad's spinning motion. Therefore, it is important to keep the top of the pad as flexible as possible, to keep the fibers as erect as possible, and to assure that there is an abundance of open pores available to receive newly applied abrasive particles.

One problem that arises with regard to maintaining the pad surface, however, is an accumulation of polishing debris coming from the work piece, the abrasive slurry, and the pad dresser. This accumulation causes a "glazing" or hardening of the top of the pad, mats the fibers down, and thus makes the pad surface less able to hold the abrasive particles of the slurry. These effects significantly decrease the pad's overall polishing performance. Further, with many pads, the pores used to hold the slurry, become clogged, and the overall asperity of the pad's polishing surface becomes depressed and matted. A CMP pad dresser can be used to revive the pad surface by "combing" or "cutting" it. This process is known as "dressing" or "conditioning" the CMP pad. Many types of devices and processes have been used for this purpose. One such device is a disk with a plurality of superhard crystalline particles such as diamond particles attached to a metal matrix surface.

One effective method of attaching superhard crystalline particles to the metal matrix is by bonding with a brazing alloy. The braze can hold the particles firmly in the CMP pad dresser due to the formation of carbide bonds at the braze-particle interface. Many braze alloys are not, however, acid proof. Typical chemical slurries are often acidic, and thus can break down the braze alloy. As a result, superhard crystalline particles may be dislodged and possibly scratch the work piece.

As a result, various tools, including CMP pad dressers, having improved caustic resistant characteristics that are suitable for working in caustic environments are being sought.

SUMMARY OF THE INVENTION

Accordingly, the present invention provides caustic resistant tools and methods for making and using such tools. In one aspect, for example, a method of providing caustic resistance along an entire working surface of a superabrasive tool having embedded superabrasive particles is provided. Such a method may include forming a protective layer through reaction between a reactive source and a reactive element in situ along substantially all of the working surface at an interface between the reactive source and a support matrix including the reactive element, and between each of a plurality of superabrasive particles and the support matrix. At least a portion of the reactive source may then be removed to expose the protective layer. In some aspects, the protective layer may be substantially continuous.

In another aspect of the present invention, a method of making a caustic-resistive superabrasive tool is provided. Such a method may include disposing a plurality of superabrasive particles partially within a temporary support substrate including a reactive source, such that the plurality of superabrasive particles extend at least partially from an interface surface of the temporary support substrate, applying a green support matrix material including a reactive element to the interface surface of the temporary support substrate such that the green support matrix material contacts the plurality of superabrasive particles, and curing the green support matrix material to form a support matrix such that a protective layer is formed in situ along substantially all of the interface surface between the temporary support substrate and the support matrix, and between each of the plurality of superabrasive particles and the support matrix, the protective layer being formed by reaction between the reactive source and the reactive element. At least a portion of the temporary support substrate may be removed to expose the protective layer.

It may be beneficial to level the tips of the superabrasive particles. In one aspect, the superabrasive particles may be leveled such that they protrude from the support matrix to a substantially predetermined height. Such leveling may be accomplished by a variety of methods. For example, in one specific aspect leveling may be accomplished by disposing the temporary support substrate as a layer along a leveling surface and pressing the plurality of superabrasive particles into the temporary support substrate such that the plurality of superabrasive particles contact the leveling surface. Upon removal of the leveling surface and the temporary support, the plurality of superabrasive particles protrude from the support matrix to a substantially predetermined height.

In yet another aspect of the present invention, a caustic-resistive superabrasive tool made according to aspects of the methods recited herein is provided. Such a tool may include a plurality of superabrasive particles at least partially embedded in a support matrix, and a protective layer formed along substantially all exposed working surfaces of the support matrix and formed between each of the plurality of superabrasive particles and the support matrix. In some cases the protective layer formed on the exposed working surfaces and the protective layer formed between each of the superabrasive particles and the carbide-forming support matrix is substantially continuous.

In a further aspect, a caustic-resistive superabrasive tool is provided. Such a tool may include a plurality of superabrasive particles embedded in a support matrix and a non-particulate protective layer formed along substantially all exposed working surfaces of the support matrix and formed between each of the plurality of superabrasive particles and the support matrix. As has been described, in some cases the protective layer formed on the exposed working surfaces and the protective layer formed between each of the superabrasive particles and the carbide-forming support matrix are substantially continuous.

There has thus been outlined, rather broadly, various features of the invention so that the detailed description thereof that follows may be better understood, and so that the present contribution to the art may be better appreciated. Other features of the present invention will become clearer from the following detailed description of the invention, taken with the accompanying claims, or may be learned by the practice of the invention.

DETAILED DESCRIPTION OF THE INVENTION

Definitions

Figure 1:
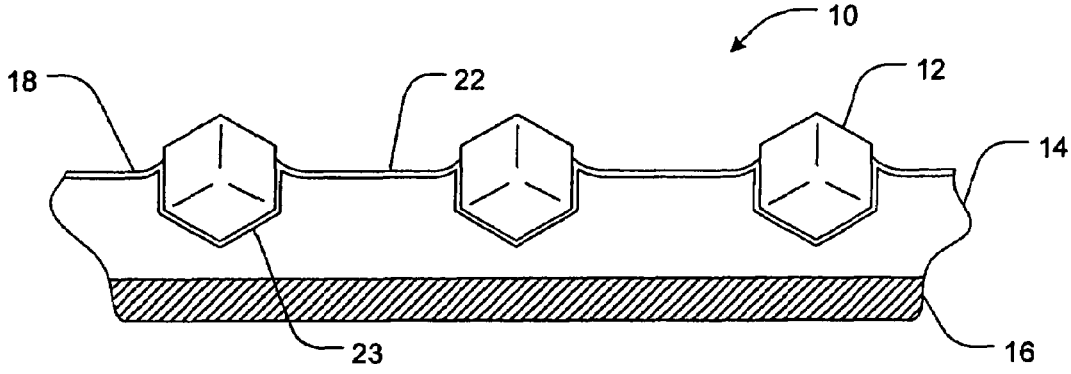
FIG. 1 is a cross-section view of a superabrasive tool in accordance with one embodiment of the present invention.

In describing and claiming the present invention, the following terminology will be used in accordance with the definitions set forth below.

The singular forms "a," "an," and, "the" include plural referents unless the context clearly dictates otherwise. Thus, for example, reference to "a particle" includes reference to one or more of such particles, and reference to "the ceramic" includes reference to one or more of such ceramics.

As used herein, "superhard" and "superabrasive" may be used interchangeably, and refer to a crystalline, or polycrystalline material, or mixture of such materials having a Vicker's hardness of about 4000 $Kg/mm^2$ or greater. Such materials may include without limitation, diamond, and cubic boron nitride (cBN), as well as other materials known to those skilled in the art. While superabrasive materials are very inert and thus difficult to form chemical bonds with, it is known that certain reactive elements, such as chromium and titanium are capable of chemically reacting with superabrasive materials at certain temperatures.

As used herein, "particle" and "grit" may be used interchangeably, and when used in connection with a superabrasive material, refer to a particulate form of such material. Such particles or grit may take a variety of shapes, including round, oblong, square, euhedral, etc., as well as a number of specific mesh sizes. As is known in the art, "mesh" refers to the number of holes per unit area as in the case of U.S. meshes.

As used herein, "chemical bond" and "chemical bonding" may be used interchangeably, and refer to a molecular bond that exert an attractive force between atoms that is sufficiently strong to create a binary solid compound at an interface between the atoms. Chemical bonds involved in the present invention are typically carbides in the case of diamond superabrasive particles, or nitrides or borides in the case of cubic boron nitride.

As used herein, the term "working surface" refers to a surface of the superabrasive tool that is intended to face or interact with a work piece. Regarding the superabrasive tools of the present invention, the working surface may be any surface that comes in direct contact with a caustic environment.

As used herein, "support matrix" refers to a material or substance that is capable of receiving superabrasive particles, including tool precursors and precursor elements as recited herein. In some aspects, a support matrix may be a complete tool body, and in other aspects, a support matrix may be only a portion or segment of a tool body.

As used herein, "reactive element" refers to an element that can chemically react with and chemically bond to a superabrasive particle. Examples of reactive elements may include without limitation, transition metals such as titanium (Ti) and chromium (Cr), including refractory elements, such as zirconium (Zr) and tungsten (W), as well as non-transition metals and other materials, such as aluminum (Al). Further, certain elements such as silicon (Si) which are technically non-metals may be included as a reactive element. Furthermore, reactive elements may also be alloyed with other reactive or non-reactive elements.

As used herein, "reactive source" refers to a material included within or comprising a support matrix which is capable of reacting with a reactive element to form a protective layer. The terms "protective layer" and "caustic-resistive layer" may be used interchangeably, and refer to properties of layers within a support matrix. It should be noted that a caustic-resistive layer may provide other protective functions beyond caustic resistance, such as mechanical or thermal protection.

As used herein, the term "about" is used to provide flexibility to a numerical range endpoint by providing that a given value may be "a little above" or "a little below" the endpoint.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually.

This same principle applies to ranges reciting only one numerical value as a minimum or a maximum. Furthermore, such an interpretation should apply regardless of the breadth of the range or the characteristics being described.

The Invention

The present invention provides caustic-resistant superabrasive tools including methods for their use and manufacture. As has been described, current superabrasive tools used in acidic or other caustic environments often degrade quickly due to caustic compounds breaking down the metal support matrix. Such degradation causes abrasive particles to pull out of the metal support matrix. In the case of CMP polishing, these loose particles often scratch and damage the wafers being polished. A protective layer that resists the degrading action of the acids during polishing may reduce the frequency of superabrasive particle pull out, and thus increase the working life of the tool. The inventor has discovered that a protective layer may be formed in situ during the construction of various superabrasive tools. This caustic-resistant layer protects the support matrix of a superabrasive tool, thus decreasing tool breakdown and wear when utilized in a caustic environment. As a specific example, a CMP pad dresser having superabrasive particles embedded in a support matrix protected with a protective carbide layer has improved acid resistance when utilized with acidic chemical slurries. It should be noted that, although much of the discussion herein may be related to CMP pad dressers and acid protection, the various aspects of the present invention are equally applicable to any type of superabrasive tool used in various caustic environments, all of which are considered to be within the current scope.

Accordingly, in one aspect of the present invention, a method of providing caustic resistance along an entire working surface of a superabrasive tool having embedded superabrasive particles is disclosed. Such a method may include forming a protective layer through reaction between a reactive source and a reactive element in situ along substantially all of the working surface at an interface between a reactive source and a support matrix including a reactive element, and between each of a plurality of superabrasive particles and the support matrix. The method may also include removing at least a portion of the reactive source to expose the protective layer.

In another aspect, a caustic-resistive superabrasive tool is provided. Such a tool may include a plurality of superabrasive particles at least partially embedded in a support matrix, and a protective layer formed along substantially all exposed working surfaces of the support matrix, and formed between each of the plurality of superabrasive particles and the support matrix.

It should be noted that the protective layers according to the present invention are continuous in nature, and are thus non-particulate. In other words, the protective layer is formed in situ through reaction with between the reactive source and the reactive element, as opposed to merely applying an acid resistive substance in a particulate or other form to the support matrix. In yet another aspect, a method of making a caustic-resistive superabrasive tool as described above is provided. Such a method may include disposing a plurality of superabrasive particles partially within a temporary support substrate such that the plurality of superabrasive particles extend at least partially from a working surface of the temporary support substrate. In other words, superabrasive particles are arranged along the temporary substrate such that they touch and extend away from the temporary substrate. The method may further include applying a green support matrix material to the working surface of the temporary support substrate such that the green support matrix material contacts the plurality of superabrasive particles. The green support matrix may be cured to form a support matrix such that a protective layer is formed in situ along substantially all of an interface between the temporary support substrate and the support matrix, and between each of the plurality of superabrasive particles and the support matrix. At least a portion of the temporary support substrate may then be removed to expose the protective layer.

Protective layers according to the various aspects of the present invention may provide protection to the superabrasive tool when used in caustic environments. Such caustic environments may include acidic, basic, or any other environment that may corrode the superabrasive tool. The protective layer can be any material capable of being formed in situ from chemical reaction between a reactive source and a reactive element associated with the support matrix. For example, in one aspect the support matrix may include a reactive element such as Si or a Si-containing alloy such as Si—Cu. If graphite is used as a reactive source, a SiC protective coating will be formed across all surfaces where Si contacts C from the graphite during curing of the support matrix. Additionally, if diamond superabrasive particles are used, a SiC coating will also be formed along the interface between the support matrix and each of the diamond particles as a result of the Si/C reaction between the two materials. Because the graphite layer also contacts the diamond particles, the SiC protective layer should be continuous across the entire working surface of the superabrasive tool. As another example, the protective layer may also be similarly formed as a nitride layer. In the case of nitrides, one method may include utilizing a polyurethane sheet as a reactive source to form a SiN protective layer. Similarly, if cBN superabrasive particles are used, a SiN coating will also be formed along the interface between the support matrix and each of the cBN particles as a result of the Si/N reaction between the two materials. One of ordinary skill in the art, once in possession of the present disclosure, would comprehend various other materials that may be used as reactive sources, all of which are considered to be within the scope of the present invention.

In addition to protecting the support matrix from caustic environments, the protective layer also may act to more firmly bond the superabrasive particles into the superabrasive tool.

For example, a SiC coating on a diamond superabrasive particle contains strong chemical bonds between the Si material of the support matrix and the C material of the diamond particle. These strong bonds help to more firmly anchor the superabrasive particles into the support matrix and thus reduce the occurrence of particle pull-out during use.

The protective layers of the present invention may be formed in situ through chemical reaction between the reactive element associated with the support matrix and a reactive source. The reactive source may include the material that makes up the temporary support substrate, or it may be a portion or a layer of the temporary support substrate. The materials that make up the reactive element and the temporary support substrate are thus chosen to react to form a protective layer that substantially covers any exposed working surface of the superabrasive tool. As such, the temporary support substrate may contact the support matrix in any region that may become exposed to a caustic environment during use of the finished tool. Various reactive sources are contemplated, as described above, including, without limitation, carbon sources, nitrogen sources, etc. In addition to the temporary support substrate, a reactive source is also present in the superabrasive particle material. For example, diamond superabrasive particles may act as a carbon source to generate a protective layer between the diamond and the support matrix. Cubic boron nitride particles, on the other hand, may act as a nitrogen source to generate a protective layer between the cubic boron nitride and the support matrix.

An exposed surface may be any surface that is exposed to an environment that may benefit from a protective layer, or in other words, a working surface. The protective layer may also be utilized along surfaces that may not be working surfaces, but that may be exposed to an acidic environment through close proximity to a working surface. In some aspects, the protective layer may be located along specific surfaces according to the intended use of a specific tool. Additionally, multiple protective layers may be utilized in a superabrasive tool. For example, protective layers may be arranged such that as one layer is eroded, another layer is exposed to further protect the tool.

Materials for the construction of the support matrix may be chosen to adequately secure the superabrasive particles in the superabrasive tool, and to contain a reactive element that will react with the reactive source to form the protective layer. The level of retention, and thus the properties of the support matrix, may vary depending on the intended use of a particular superabrasive tool. In one aspect, the support matrix and the reactive element may be the same material. For example, a superabrasive tool may be constructed of a Si support matrix. Such a matrix would also function as the reactive element to react with a temporary support substrate such as graphite. In this case, a SiC protective layer would be formed in situ during the construction of the superabrasive tool from the temporary support substrate and the support matrix itself.

In some aspects, however, Si alloys may be preferable due to their lower melting temperatures. The thermal stability limit of many superabrasive materials, such as diamond, ranges from about 900° C. to about 1200° C. Non-alloyed Si thus has a very high melting temperature, and thus may degrade and weaken diamond superabrasive particles during formation of the superabrasive tool. Si alloys with lower melting temperatures would thus allow tool formation without such degradation. As such, in one aspect of the invention, the components and exact ratios of the reactive element/support matrix alloy may be selected to provide an alloy that has a melting point within or below the thermal stability limit of the particular superabrasive material being used. In practice, materials may be selected and combined in proper amounts to reduce the melting temperature of both elements to yield a support matrix having a melting temperature of less than about 1200° C. In yet another aspect, the melting temperature may be below about 900° C. In a further aspect, the melting temperature may be below about 700° C. In a further aspect, the melting temperature may be below about 500° C.

It is contemplated that any Si alloy that would function to hold superabrasive particles in a support matrix would be considered to be within the scope of the present invention. This may include Si alloyed with metals or non-metals. Examples may include, without limitation, Si—Cu, Si—Ge, Si—Al, and combinations thereof. Alloys are also not limited to binary combinations, but may also include more than two component materials.

In the above Si example, the content of Si in the alloy may have a very broad range, depending on the particular superabrasive tool and tool use. For example, in one aspect, the content of Si in the alloy may be from about 10% w/w to about 90% w/w. Si content of greater than about 90% w/w are contemplated, however degradation to the superabrasive particles may occur. In certain superabrasive tools, such degradation may not be particularly detrimental. Also, though Si content of less than 30% w/w are contemplated, protective layers may be formed more readily at contents of greater than about 30% w/w. As such, in another aspect, the content of Si may be greater than about 30% w/w. In yet another aspect, the content of Si may be from about 30% w/w to about 90% w/w.

As has been discussed, a reactive element that is a carbide former in contact with a reactive carbon source during formation of a superabrasive tool can form a protective carbide layer in situ to provide protection to the support matrix from caustic environments. In one aspect, the reactive element may be dispersed throughout at least a substantial portion of the support matrix. This may be accomplished by mixing the reactive element with another metal or nonmetal material.

Additionally, in one aspect an alloy may be formulated to include sufficient amounts of reactive elements to create the protective layer. In another aspect, the reactive element may be associated within a limited region of the support matrix. For example, a reactive element may be present primarily at the interface between the support matrix and the reactive source. This may be accomplished by numerous means, such as distributing the reactive element across a green support matrix material prior to adding a temporary substrate material or a reactive source, or it may be distributed across a reactive source prior to adding the green support matrix material. The reactive element can be distributed as a slurry, a paste, a powder, a foil, a vapor deposited layer, or any other means known to one of ordinary skill in the art.

A number of reactive elements may be included in a support matrix in order to achieve a desired bonding with the superabrasive particle and to react with the reactive source to form a protective layer. A wide variety of reactive elements can be utilized with the support matrix, the selection of which may depend on the particular design of the superabrasive tool. Examples of suitable reactive elements for inclusion in a support matrix used in the present invention include without limitation, members selected from the group consisting of: aluminum (Al), boron (B), chromium (Cr), lithium (Li), magnesium (Mg), molybdenum (Mo), manganese (Mn), nirobium (Nb), silicon (Si), tantalum (Ta), titanium (Ti), vanadium (V), tungsten (W), zirconium (Zr), and mixtures thereof. The reactive element may also be chosen in order to react with the superabrasive particles to create a protective layer therebetween.

As will be recognized by those of ordinary skill in the art, numerous combinations of specific reactive metals with other metals and nonmetals may be alloyed in different ratios or amounts to achieve an alloy that chemically bonds to the superabrasive particle, has a suitable melting point, and reacts with the reactive source to form a protective layer in situ. However, in one aspect, the content of the reactive element may be at least about 5% of the alloy. In another aspect, the amount of reactive element may be at least about 10% of the alloy. In yet another aspect, the amount of reactive element may be at least about 30% of the alloy.

The superabrasive particles used in embodiments of the present invention may be selected from a variety of specific types of diamond and cubic boron nitride. It may be useful to select a superabrasive material capable of chemically bonding with a reactive element to form a protective layer. Further, these particles may take a number of different shapes as required to accommodate a specific purpose for the tool into which it is anticipated that they will be incorporated. However, in one aspect, the superabrasive particle may be diamond, including natural diamond, synthetic diamond, etc. In yet another aspect, the superabrasive particle may be cubic boron nitride (cBN). In other aspects, various other materials may be utilized as superabrasive particles, including, without limitation, SiC, $Al_2O_3$, $ZrO_2$, WC, and combinations thereof.

It should be noted that in one aspect a reactive element may be coated onto the superabrasive particles prior to incorporation into a superabrasive tool. Such coating may occur by any known means, such as, without limitation, dipping, spraying, vapor depositing, gluing, etc.

Superabrasive particles may be of any size suitable for use in a particular tool, or for a particular purpose. In one aspect, however, superabrasive particles may range in size from about 400 mesh (~37 microns) to about 20 mesh (~850 microns). In another aspect, superabrasive particles may range in size from about 200 mesh (~75 microns) to about 80 mesh (~180 microns).

Various configurations of superabrasive tools are contemplated. The following are merely exemplary, and no limitation is therefore intended. FIG. 1 shows an acid resistant superabrasive tool 10 having superabrasive particles 12 disposed in a support matrix 14. In one aspect, a second substrate 16 may be coupled to the support matrix 14. An protective layer 18 may be formed along substantially all of the working surface of the superabrasive tool to provide caustic resistance to the tool. The protective layer 18 may be located along the surface 22 of the superabrasive tool 10 and between 23 each of the superabrasive particles 12 and the support matrix 14. As can be seen from FIG. 1, in one aspect, the protective layer 18 may be continuous.

Figure 2:
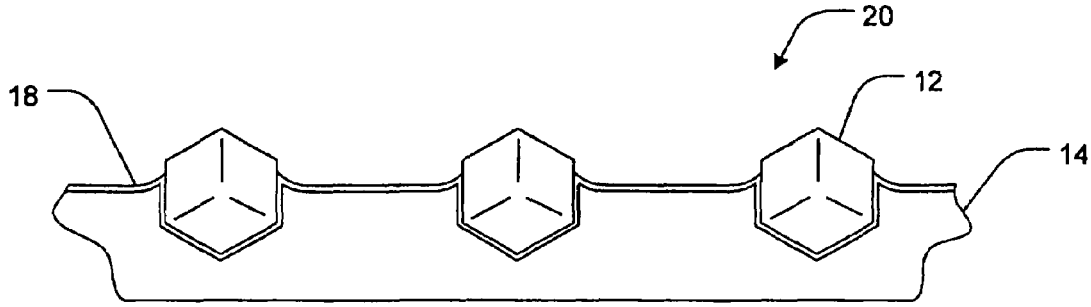
FIG. 2 is a cross-section view of a superabrasive tool in accordance with another embodiment of the present invention.
Figure 3:
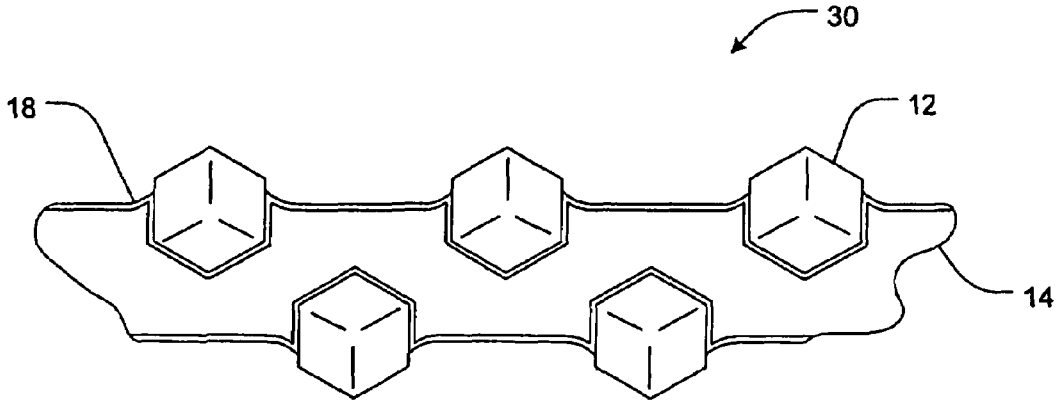
FIG. 3 is a cross-section view of a superabrasive tool in accordance with yet another embodiment of the present invention.

In another aspect, as shown in FIG. 2, a superabrasive tool 20 may comprise superabrasive particles 12 bonded together by a support matrix 14 in a configuration that lacks a second substrate. In yet another aspect, as shown in FIG. 3, superabrasive particles 12 may be bonded on multiple sides of a superabrasive tool 30. Such a configuration may also include superabrasive particles bonded on multiple sides of a second substrate (not shown). It should be noted, however, that the location and orientation of the superabrasive particles shown in these figures should not be seen as limiting to the scope of the claims of the present invention. Also, it should be noted that while the superabrasive particles of the tools shown in FIGS. 1, 2 and 3 are arranged in accordance with a predetermined pattern, in some aspects, the particle positioning may be random.

Figure 4:
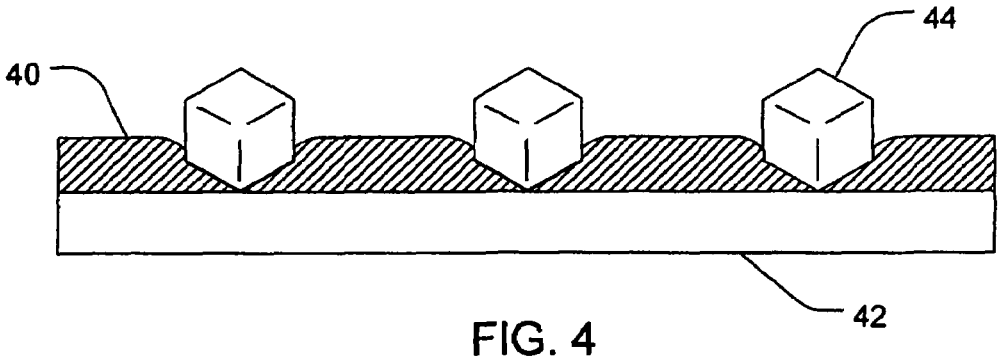
FIG. 4 is a cross-section view of a superabrasive tool being constructed in accordance with a further embodiment of the present invention.

Various aspects of the present invention may also provide methods of manufacturing superabrasive tools having a protective layer formed in situ. Though any method of manufacture may be utilized, it may be beneficial to reverse case the superabrasive tool in order to level the tips of the superabrasive particles of the tool. As such, FIGS. 4-7 show one exemplary aspect comprising a method of reverse casting. As shown in FIG. 4, a temporary support substrate 40 is disposed along a leveling surface 42. Superabrasive particles 44 are disposed into the temporary support substrate 40 to contact the leveling surface 42. One of ordinary skill in the art in possession of this disclosure will recognize that there are numerous methods of disposing the superabrasive particles in the temporary support substrate. Temporary support substrate materials can be in any form known, for example, without limitation, powdered or particulate materials, layered materials, etc. The superabrasive particles may be placed into or on top of the temporary support substrate, or the temporary support substrate may be applied onto or around the superabrasive particles. For example, in those aspects utilizing powdered or particulate temporary support substrate materials, superabrasive particles may be disposed upon or into the powdered temporary support substrate. Alternatively, powdered temporary support substrate can be spread across superabrasive particles that have been previously arranged or disposed onto the leveling surface. In those aspects utilizing temporary support substrate layered materials, the layered material may be placed on top of the leveling surface, and the superabrasive particles may be disposed on top of and pressed thereinto. Additionally, in yet another alternative embodiment, a superabrasive tool may be constructed without a leveling surface, with the superabrasive particles being pressed into the temporary support substrate a given distance.

Contacting the superabrasive particles 44 against the leveling surface 42 allows the tips of the superabrasive particles 44 to be substantially leveled in the resulting superabrasive tool. It may be beneficial to press the superabrasive particles 44 into the temporary support substrate 40 with a deformable material, such as, without limitation, rubbers, plastics, etc. The deformable material can deform slightly around larger superabrasive particles and still provide sufficient force to press smaller superabrasive particles into the temporary support substrate to contact the leveling surface.

In one aspect, the superabrasive particles can be arranged in a predetermined pattern. Disposing superabrasive particles according to a predetermined pattern may be accomplished by applying spots of glue to a substrate, by creating indentations in the substrate to receive the particles, or by any other means known to one skilled in the art. Additional methods may be found in U.S. Pat. Nos. 6,286,498, 6,039,641, 5,380, 390, and 4,925,457, which are incorporated herein by reference. In another aspect, the superabrasive particles may be disposed in a random or pseudorandom arrangement. Random and pseudorandom arrangements are intended to encompass situations where the superabrasive particles are disposed in the superabrasive tool with little or no regularity of spacing, even though such an arrangement may be predetermined. Similarly, in yet another aspect, superabrasive particles may be disposed in a regular or fairly regular pattern during the manufacturing process without such a regular or fairly regular pattern being predetermined.

It may be desirable to orient the superabrasive particles such that their tips are oriented toward a work piece. In one aspect, the leveling surface can be roughened to create pits. When the superabrasive particles are pressed against the leveling surface the tips of the superabrasive particles may be oriented by the pits, thus orienting the particles in a uniform direction. In another aspect, nylon or other mesh material can be disposed along the leveling surface to provide "pits" for orienting the superabrasive particles.

Figure 5:
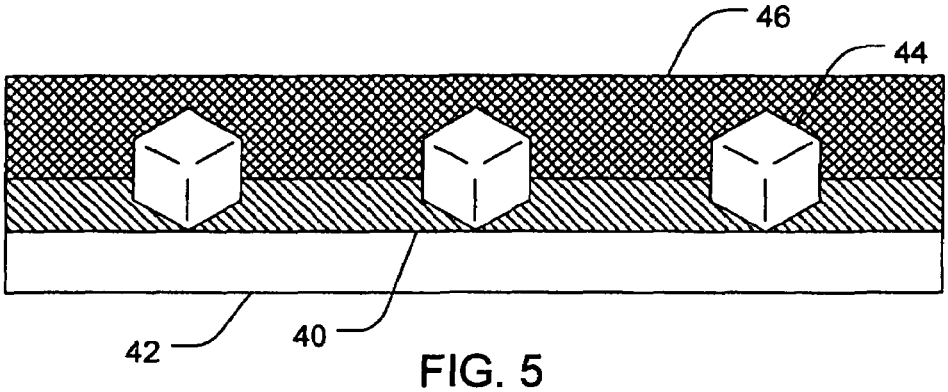
FIG. 5 is a cross-section view of a superabrasive tool being constructed in accordance with yet a further embodiment of the present invention.
Figure 6:
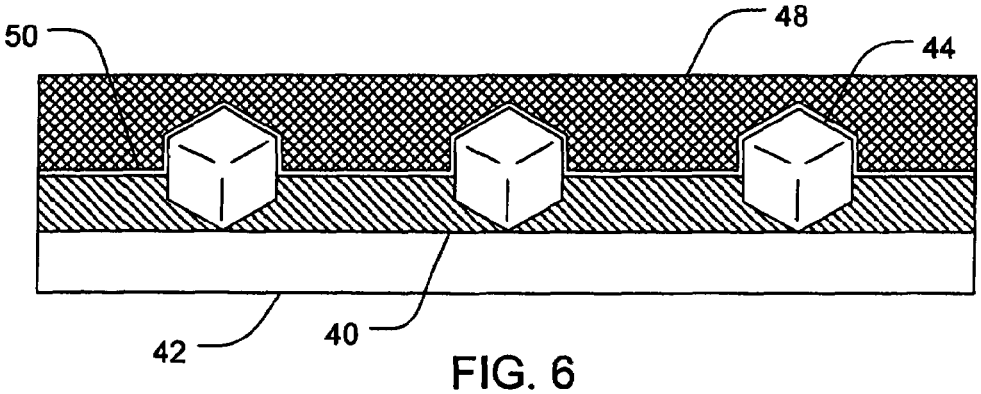
FIG. 6 is a cross-section view of a superabrasive tool being constructed in accordance with yet another embodiment of the present invention.

Following the placement of the superabrasive particles 44, a green support matrix 46 may be applied to the temporary support matrix 40 as shown in FIG. 5. The green support matrix 46 contacts both the temporary support matrix 40 and the superabrasive particles 44. The superabrasive particles 44 should extend from the temporary support matrix 40 into the green support matrix 46 a sufficient distance to allow bonding to occur between the superabrasive particles 44 and the formed support matrix. The green support matrix may then be cured to form a support matrix 48 as shown in FIG. 6. As the support matrix 48 is being cured, a protective layer 50 is formed in situ by reaction between the reactive source and the reactive element between the support matrix 48 and the temporary support matrix 40 and between the support matrix 48 and the superabrasive particles 44. This protective layer 50 may be continuous, and may protect the superabrasive tool from degradation in caustic environments.

Figure 7:
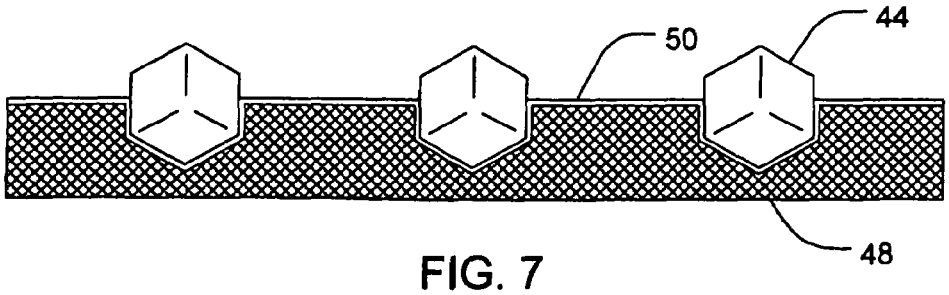
FIG. 7 is a cross-section view of a superabrasive tool being constructed in accordance with a further embodiment of the present invention.

Following curing of the support matrix 48 and the formation of the protective layer 50, the leveling support 42 and the temporary support matrix 40 may be removed to expose the protective layer 50 as shown in FIG. 7. These materials may be removed by grinding, sandblasting, etching, etc.

Numerous uses of aspects of the present invention will be apparent to one skilled in the art in possession of the present disclosure. Superabrasive particles can be arranged into tools and tool precursors of various shapes and sizes, including one-, two-, and three-dimensional tools. In some aspects, a single superabrasive particle in a support matrix can act as a tool or a tool precursor for incorporation into a tool. As alluded to above, in some aspects the tools or tool precursors may consist essentially of superabrasive particles in a support matrix. Tools may incorporate a single layer or multiple layers of superabrasive particles. One example of a tool incorporating a single layer of superabrasive particles in a support matrix is a CMP pad dresser.

Of course, it is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A method of making a caustic-resistive superabrasive tool, comprising:

disposing a plurality of superabrasive particles partially within a temporary support substrate including a reactive source, such that the plurality of superabrasive particles extend at least partially from an interface surface of the temporary support substrate;

applying a green support matrix material including a reactive element to the interface surface of the temporary support substrate such that the green support matrix material contacts the plurality of superabrasive particles;

curing the green support matrix material to form a support matrix such that a protective layer is formed in situ along substantially all of the interface surface between the temporary support substrate and the support matrix, the protective layer being formed by reaction between the reactive source and the reactive element; and removing at least a portion of the temporary support substrate to expose the protective layer.

2. The method of claim 1, wherein curing the green support matrix material further includes forming the protective layer in situ between each of the plurality of superabrasive particles and the support matrix.

3. The method of claim 1, further comprising leveling the plurality of superabrasive particles such that they protrude from the support matrix to a substantially predetermined height.

4. The method of claim 1, wherein predetermined height is substantially uniform across all superabrasive particles.

5. The method of claim 3, wherein leveling further includes:

disposing the temporary support substrate as a layer along a leveling surface; and pressing the plurality of superabrasive particles into the temporary support substrate such that the plurality of superabrasive particles contact the leveling surface, wherein upon removal of the leveling surface and the temporary support the plurality of superabrasive particles protrude from the support matrix to a substantially predetermined height.

6. The method of claim 5, wherein the leveling surface is a flat surface.

7. The method of claim 5, wherein the leveling surface is a curved surface.

8. The method of claim 5, wherein pressing the plurality of superabrasive particles into the temporary support substrate includes pressing with a deformable material.

9. The method of claim 5, further comprising:

disposing an orienting mesh onto the leveling surface prior to disposing the temporary support substrate as a layer, such that tips of the plurality of superabrasive particles are oriented toward the leveling surface upon pressing the plurality of superabrasive particles into the temporary support substrate.

10. The method of claim 5, further comprising roughing the leveling surface prior to disposing the plurality of superabrasive particles thereon such that, when the plurality of superabrasive particles are pressed into the temporary support substrate, the roughened leveling surface positions a substantial portion of the plurality of superabrasive particles with a tip oriented toward the leveling surface.

11. The method of claim 1, wherein the reactive source includes a member selected from the group consisting of a carbon source, a nitrogen source, and combinations thereof.

12. The method of claim 11, wherein the carbon source includes graphite.

* * * * *